US006786348B2

(12) United States Patent
Martin et al.

(10) Patent No.: US 6,786,348 B2
(45) Date of Patent: Sep. 7, 2004

(54) GASKET FOR PRESS-ON TWIST-OFF CLOSURE

(75) Inventors: Jim L. Martin, Lancaster, OH (US); Larry A. Hottle, Lancaster, OH (US); Galen G. German, Lancaster, OH (US); C. Roger Hamrick, London, OH (US)

(73) Assignee: Crown Cork & Seal Technologies Corporation, Alsip, IL (US)

( * ) Notice: Subject to any disclaimer, the term of this patent is extended or adjusted under 35 U.S.C. 154(b) by 0 days.

(21) Appl. No.: 09/864,410

(22) Filed: May 24, 2001

(65) Prior Publication Data

US 2002/0175138 A1 Nov. 28, 2002

(51) Int. Cl.[7] ..... B65D 41/04; B65D 41/17

(52) U.S. Cl. ..... 215/318; 215/327; 215/341; 220/289; 220/304

(58) Field of Search ..... 215/318, 327, 215/233, 321, 324, 328, 341; 220/289, 304, 296

(56) References Cited

U.S. PATENT DOCUMENTS

| | | | | |
|---|---|---|---|---|
| 3,371,813 A | | 3/1968 | Owen et al. | |
| 3,448,881 A | | 6/1969 | Zipper | |
| 3,741,423 A | | 6/1973 | Acton et al. | |
| 4,000,825 A | | 1/1977 | Westfall | |
| 4,452,365 A | * | 6/1984 | Ascasibar-Verdejo | 215/346 |
| 4,552,279 A | | 11/1985 | Mueller et al. | |
| 4,576,299 A | | 3/1986 | Lecinski, Jr. | |
| 4,603,786 A | | 8/1986 | Lecinski, Jr. et al. | |
| 4,709,825 A | * | 12/1987 | Mumford | 215/318 |
| 4,717,034 A | * | 1/1988 | Mumford | 215/318 |
| 4,863,030 A | | 9/1989 | Bayer et al. | |
| 5,119,962 A | * | 6/1992 | Vercillo et al. | 215/230 |
| 5,692,628 A | | 12/1997 | Montgomery et al. | |
| 5,887,738 A | * | 3/1999 | Bietzer et al. | 215/232 |

* cited by examiner

*Primary Examiner*—Lee Young
*Assistant Examiner*—Niki M. Eloshway
(74) *Attorney, Agent, or Firm*—Knoble Yoshida & Dunleavy, LLC

(57) ABSTRACT

A press-on, twist-off container assembly of the type that is used, for example, and baby food containers includes a container that has, as conventional, a finish portion with at least one external threadand a closure that is mounted on the container. The closure is of the press-on, twist-off type and includes a panel portion and a skirt portion that together define a generally cylindrical interior recess. As is conventional, a deformable gasket is mounted within the interior recess that has a thread engaging portion that is deformed so as to at least partially conform to the external threads of said finish portion of said container. The thread engaging portion advantageously has a plurality of inwardly extending raised flutes that are circumferentially spaced irregularly about the thread engaging portion. At least some of the flutes are in contact with at least one of the external threads at respective points of contact, and each external thread has a total distance spanned by such points of contact. As a result of the irregular spacing of the flutes, the container assembly will have an aggregate distance spanned that is a sum of the total distance spanned for all of the external threads that is less than it would be were the flutes spaced regularly. Accordingly, the amount of torque that is necessary to remove the closure is comparatively reduced.

6 Claims, 3 Drawing Sheets

GASKET FOR PRESS-ON TWIST-OFF CLOSURE

BACKGROUND OF THE INVENTION

1. Field of the Invention

This invention relates to a closure of the type which may be applied to a helically threaded finish of a glass or rigid plastic container by a press-on action, but which may be normally removed from the finish of the container only by a twisting action. More particularly, this invention relates to a press-on, twist-off closure that is constructed and arranged to optimize torque that is required to remove the closure.

2. Description of the Related Technology

Closure caps of the press-on turn-off variety for glass or hard plastic containers are known and are in wide commercial use. Such closure caps provide a hermetic seal with the container for packing and holding hot-fill or cool food or beverage products such as baby food. Typically, such closure caps have a metallic body including a top panel and a depending skirt portion, both of which are lined with a deformable gasket material. This construction permits the closure caps to be pressed vertically downwardly onto the mouths of glass containers that are provided with circumferential bands of thread formations. The gaskets are formed of suitable plastomeric compounds such as plastisols, which are capable of taking cold flow sets under compression and thereby form thread formations which compliment or mate with those on the neck of the containers. The closure cap may then be removed by a consumer by twisting it like an ordinary twist off closure to unscrew it from the container.

Conventional closure caps of the press-on turn-off variety tend in many cases to be difficult to open for some consumers because of the amount of torque that is required to remove the closure cap from the container. In an attempt to address this issue, certain closure caps that are in commercial use are provided with equally spaced flutes of raised gasket material on the inside of the depending skirt portion of the closure, which is intended to reduce the amount of contact surface between the gasket and the container threads. In actual practice, however, such closures do not always provide the desired removal torque. The inventors have determined that this is due in part to the fact that the equal and symmetrical spacing of the flutes provides too much contact with the embedded glass container threads.

A need exists for an improved closure cap of the press-on turn-off variety that is configurable so as to permit a significant reduction in the amount of torque that is required to remove the closure cap from a container, without compromising the quality of the hermetic seal that is formed with the container during packaging.

SUMMARY OF THE INVENTION

Accordingly, it is an object of the invention to provide an improved closure cap of the press-on turn-off variety that is configurable so as to permit a significant reduction in the amount of torque that is required to remove the closure cap from a container, without compromising the quality of the hermetic seal that is formed with the container during packaging.

In order to achieve the above and other objects of the invention, a press-on, twist-off closure for a container of the type that has at least one external thread on a finish portion thereof includes, according to a first aspect of the invention, a panel portion; a skirt portion depending downwardly from the panel portion, the skirt portion and the panel portion together defining a generally cylindrical interior recess; and a deformable gasket mounted within the interior recess, the deformable gasket having a thread engaging portion that is mounted to an inner surface of the skirt portion, and wherein the thread engaging portion comprises a plurality of raised flutes that are integral with the deformable gasket and wherein the raised flutes are arranged in a plurality of separate groups about an inner circumference of the thread engaging portion, each of the separate groups containing at least two flutes, and wherein a circumferential distance between any two adjacent groups is greater than a circumferential distance between any two adjacent flutes within a group, so that when mounted on a container the total span of contact of the flutes across individual external threads of the container will be less than if the flutes were evenly spaced, whereby the torque needed to remove the closure from the container will be less than if the flutes were evenly spaced.

According to a second aspect of the invention, a press-on, twist-off container assembly includes a container having a finish portion with at least one external thread defined thereon; and a press-on, twist-off type closure including a panel portion; a skirt portion depending downwardly from the panel portion, the skirt portion and the panel portion together defining a generally cylindrical interior recess; and a deformable gasket mounted within the interior recess, the deformable gasket having a thread engaging portion that is deformed so as to at least partially conform to the external threads of the finish portion of the container, the thread engaging portion having a plurality of inwardly extending raised flutes, and wherein at least some of the flutes are in contact with at least one of the external threads at respective points of contact, each external thread having a total distance spanned by such points of contact, and wherein an aggregate distance spanned that is a sum of the total distance spanned for all of the external threads is less than an internal circumference of the thread engaging portion.

According to a third aspect of the invention, a press-on, twist-off container assembly includes a container having a finish portion with at least one external thread defined thereon; and a press-on, twist-off type closure including a panel portion; a skirt portion depending downwardly from the panel portion, the skirt portion and the panel portion together defining a generally cylindrical interior recess; and a deformable gasket mounted within the interior recess, the deformable gasket having a thread engaging portion that is deformed so as to at least partially conform to the external threads of the finish portion of the container, the thread engaging portion having a plurality of inwardly extending raised areas, and wherein at least some of the raised areas are in contact with at least one of the external threads at respective lengths of contact, each external thread having a total distance spanned by a sum of such lengths of contact and distances spanned by adjacent raised areas on the thread, and wherein an aggregate distance spanned that is a sum of the total distance spanned for all of the external threads is less than an internal circumference of the thread engaging portion.

According to a fourth aspect of the invention, a press-on, twist-off container assembly includes a container having a finish portion with at least one external thread defined thereon; and a press-on, twist-off type closure including a panel portion; a skirt portion depending downwardly from the panel portion, the skirt portion and the panel portion together defining a generally cylindrical interior recess; and a deformable gasket mounted within the interior recess, the deformable gasket having a thread engaging portion that is deformed so as to at least partially conform to the external threads of the finish portion of the container, the thread engaging portion having a plurality of inwardly extending raised flutes, the flutes being circumferentially spaced irregularly about the thread engaging portion, and wherein at least some of the flutes are in contact with at least one of the external threads at respective points of contact, each external thread having a total distance spanned by such points of contact, whereby the irregular spacing of the flutes will cause the container assembly to have an aggregate distance spanned that is a sum of the total distance spanned for all of the external threads that is less than it would be were the flutes spaced regularly, whereby the amount of torque that is necessary to remove the closure is comparatively reduced.

According to a fifth aspect of the invention, a method of making a press-on, twist-off container assembly includes steps of (a) providing a container having a finish portion with at least one external thread defined thereon; (b) providing a press-on, twist-off type closure including a panel portion and a skirt portion that together define a generally cylindrical interior recess and a deformable gasket mounted within the interior recess that has a thread engaging portion having a plurality of inwardly extending raised flutes; and (c) pressing the closure onto the container so that at least some of the flutes are in contact with at least one of the external threads at respective points of contact, each external thread having a total distance spanned by such points of contact, and wherein an aggregate distance spanned that is a sum of the total distance spanned for all of the external threads is less than an internal circumference of the thread engaging portion.

A method of making a press-on, twist-off container assembly according to a sixth aspect of the invention includes steps of (a) providing a container having a finish portion with at least one external thread defined thereon; (b) providing a press-on, twist-off type closure that includes a panel portion and a skirt portion that together define a generally cylindrical interior recess and a deformable gasket mounted within the interior recess that has a thread engaging portion having a plurality of inwardly extending raised areas; and (c) pressing the closure onto the container so that at least some of the raised areas are in contact with at least one of the external threads at respective lengths of contact, each external thread having a total distance spanned by a sum of such lengths of contact and distances spanned by adjacent raised areas on the thread, and wherein an aggregate distance spanned that is a sum of the total distance spanned for all of the external threads is less than an internal circumference of the thread engaging portion.

A method of making a press-on, twist-off container assembly according to a seventh aspect of the invention includes steps of (a) providing a container having a finish portion with at least one external thread defined thereon; (b) providing a press-on, twist-off type closure that includes a panel portion and a skirt portion that together define a generally cylindrical interior recess and a deformable gasket mounted within the interior recess that has a plurality of inwardly extending raised flutes, the flutes being circumferentially spaced irregularly about the thread engaging portion; and (c) pressing the closure onto the container so that at least some of the flutes are in contact with at least one of the external threads at respective points of contact, each external thread having a total distance spanned by such points of contact, whereby the irregular spacing of the flutes will cause the container assembly to have an aggregate distance spanned that is a sum of the total distance spanned for all of the external threads that is less than it would be were the flutes spaced regularly, whereby the amount of torque that is necessary to remove the closure is comparatively reduced.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
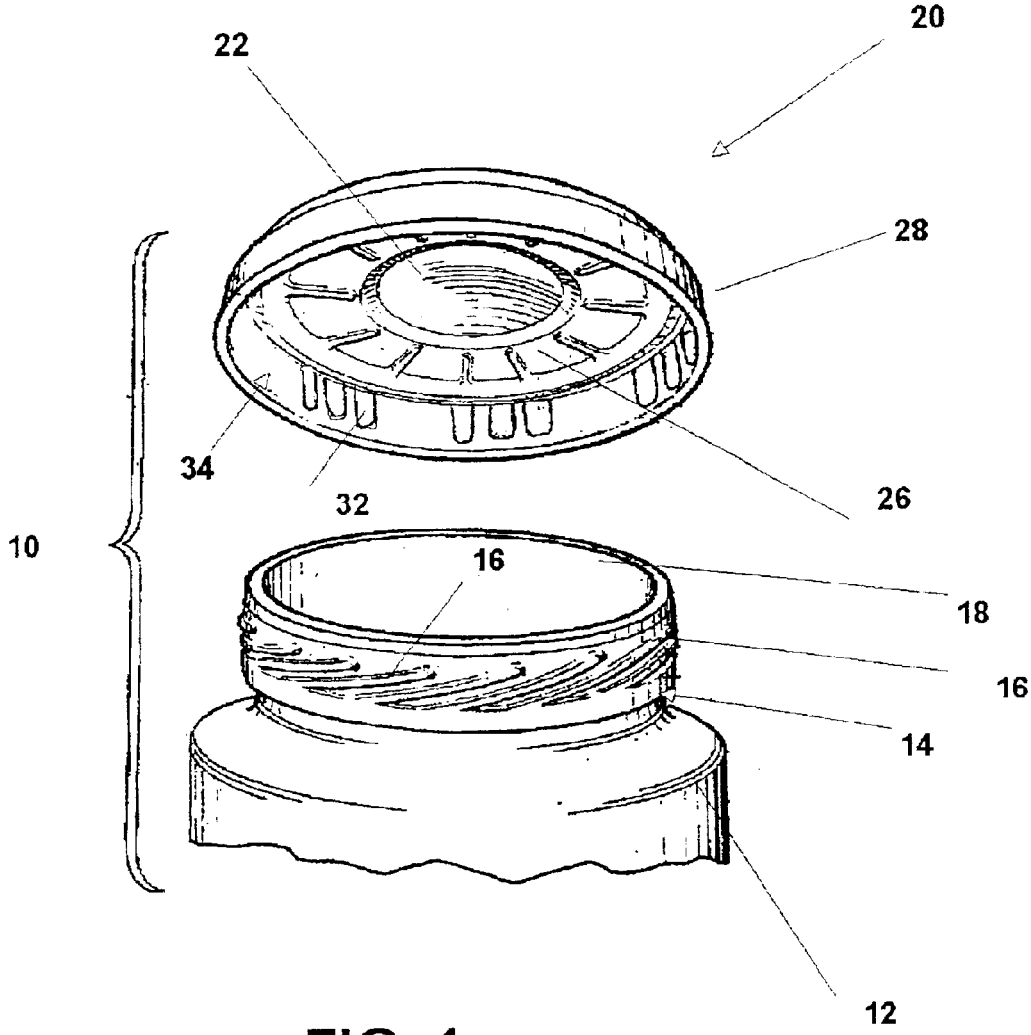
FIG. 1 is a fragmentary perspective view of a container assembly that is constructed according to a first embodiment of the invention.

Referring now to the drawings, wherein like reference numerals designate corresponding structure throughout the views, and referring in particular to FIG. 1, a container assembly 10 that is constructed according to a first embodiment of the invention includes a container 12 that is conventional in construction and that includes a finish portion 14 having at least one external thread 6 integrally molded into an external surface thereof. The finish portion 14 defines an opening 18 that provides access to the container 12.

Figure 2:
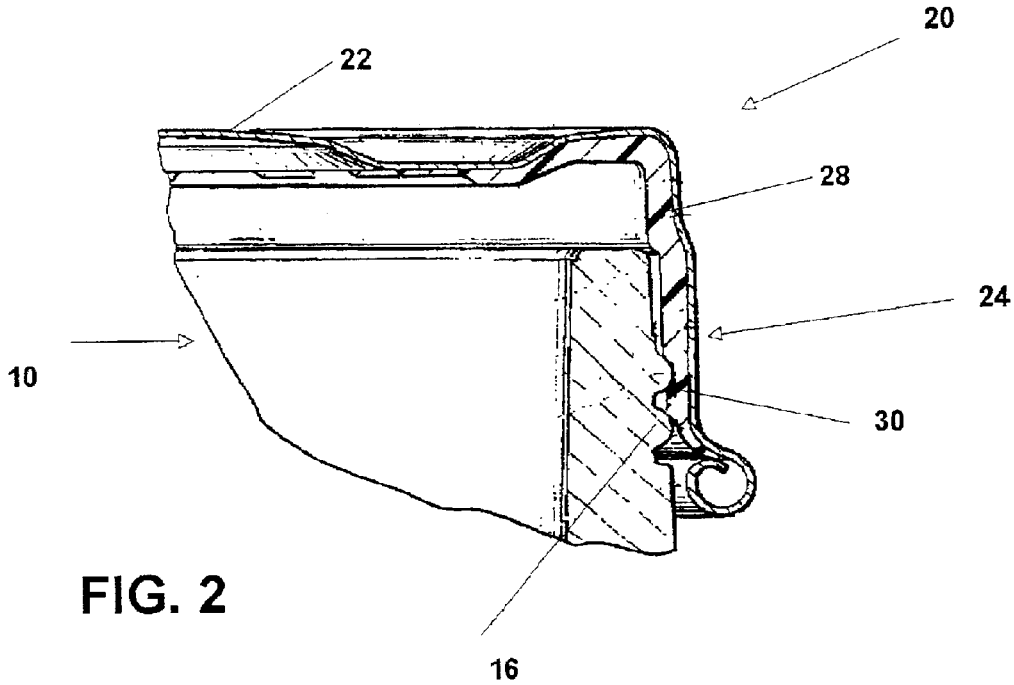
FIG. 2 is a fragmentary cross-sectional view depicting one area of the container assembly that is shown in FIG. 1.

Container assembly 10 further includes a closure 20 that has an upper panel 22 and, as is best shown in FIG. 2, a skirt portion 24 that depends downwardly from the upper panel 22 and together with the upper panel 22 defines a generally cylindrical internal recess 26 that is sized and shaped to receive the threaded finish portion 14 of the container 12. As may be seen in FIGS. 1 and 3, a deformable gasket 28, which is preferably fabricated from a material such as plastisol, is mounted within the recess 26 and includes a thread engaging portion 30 that is attached to an internal surface of the skirt portion 24.

Figure 4:
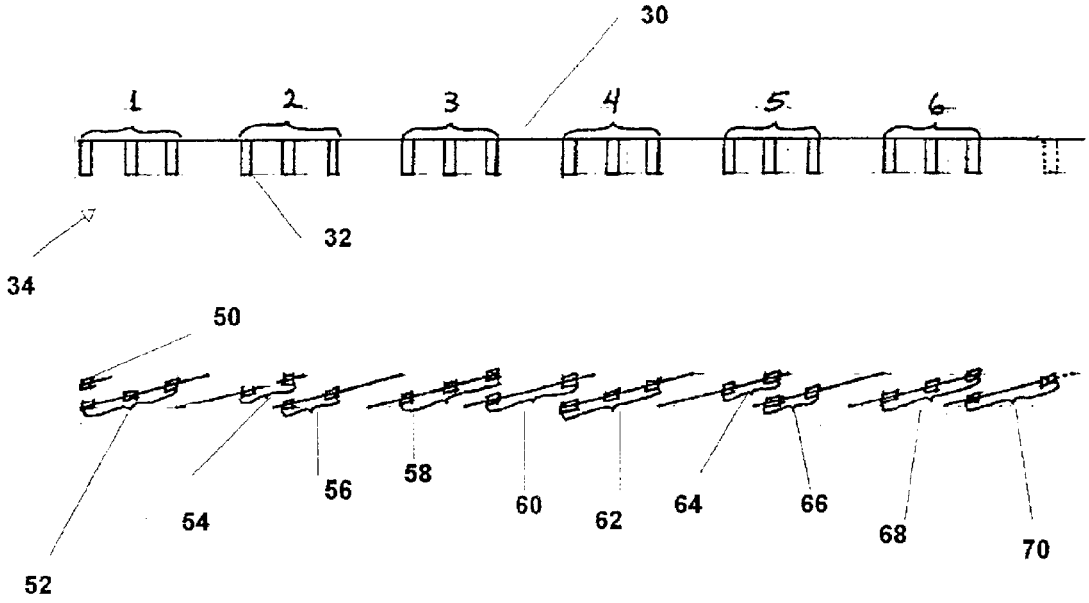
FIG. 4 is a diagrammatical view depicting advantageous operation of the container assembly that is depicted in FIG. 1.

In the first embodiment of the invention that is depicted in FIG. 1, the thread engaging portion 30 has integrally molded therein a plurality of inwardly extending raised flutes 32, which are arranged in groups 34. In the illustrated embodiment, each group 34 contains three flutes 32 that are arranged in six groups 34 that are evenly spaced about the inner circumference of the thread engaging portion 30. As may be seen in FIG. 1 and in FIG. 4, the circumferential distance between the adjacent groups 34 of flutes 32 is greater than the circumferential distance between any of the flutes 32 within any of the groups 34. Looking briefly to FIG. 4, which is a diagrammatical depiction wherein circumferential distance about the inner surface of the thread engaging portion 30 is represented as a horizontal linear distance, it will be seen that the various flutes 32 make contact with the different threads 16 on the finish portion 14 of the container 12 at a number of different contact points 50. Each external thread has a total distance that is spanned by these points of contact within the thread 16. According to one advantageous aspect of the invention, it has been found that removal torque is reduced to an optimal level when the aggregate distance spanned that is a sum of the total distance spanned for all of the external threads 16 is less than the internal circumference of the thread engaging portion 30.

This aspect of the invention will become more apparent as a result of the description of one prototype that is described below.

A prototype of the container assembly 10 was fabricated with a container 12 that had a nominal industry sizing of 51 mm. Accordingly, the inner circumference of the thread engaging portion 30 of the closure 20 was about 160 mm. As may be seen in the diagrammatical depiction provided in FIG. 4, the prototype was provided with a thread engaging portion 30 that included six groups 34 of flutes 32, which are respectively numbered as groups 1–6. The container 12 at a finish portion 14 that had 10 different threads 16 defined thereon. As may be seen in FIG. 4, a first thread contacted all three flutes 32 and the first group 34, and was measured to span a distance 52 of 16 mm along the surface of the first thread 16. A second thread contacted only the second two flutes 32 of the second group and was measured to span a distance 54 of 9 mm. A third thread contacted the second two flutes 32 in the second group, spanning a distance 56 that was measured at 9 mm. A fourth thread contacted all three flutes in the third group, spanning a distance 58 of 16 mm. A fifth thread contacted the last flute of the third group and the first flute of the fourth group, and spanned a distance 60 that was measured at 14 mm. A sixth thread contacted all three flutes within the fourth group, spanning a distance 62 of 16 mm. A seventh thread contacted only the second two flutes within the fifth group, spanning a distance 64 of 9 mm. An eighth thread contacted the last two flutes in the fifth group, spanning a distance 66 that was also 9 mm. A ninth thread contacted all three flutes in the sixth group, spanning a distance 68 of 16 mm. A tenth thread contacted the last flute in the sixth group and the first flute in the first group, spanning a distant 70 of 14 mm.

For this prototype, the aggregate distance spanned that is a sum of the total distance spanned for all of the external threads 16 was equal to about 128 mm, or an average of 12.8 mm per thread. In contrast, it has been determined that a closure of identical construction but with the flutes 32 evenly spaced about the inner periphery of the thread engaging portion would create a total distance spanned about 175 mm, which is an average of 17.5 mm per thread. Accordingly, spacing the flute members 32 in groups according to the invention permits a significant reduction in the total distance spanned, which has been found to correlate with a significant reduction in the door that is necessary for a consumer to open the container assembly 10.

Figure 3:
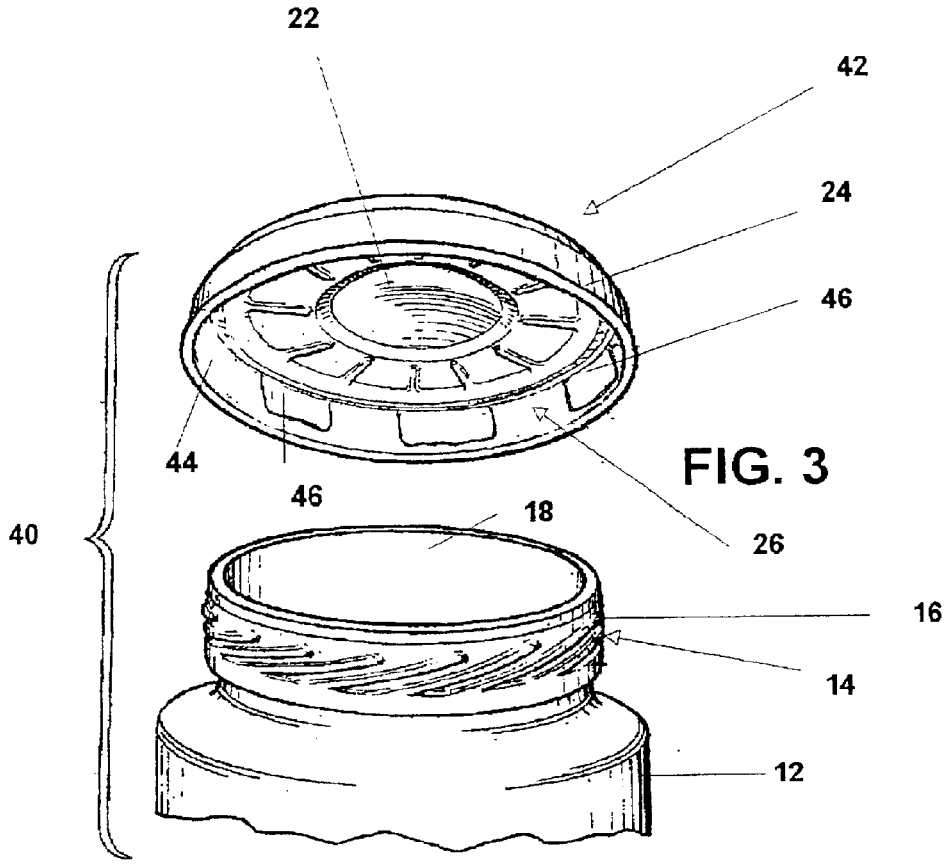
FIG. 3 is a fragmentary perspective view of a container assembly that is constructed according to a second embodiment of the invention.

A container assembly 40 that is constructed according to a second, alternative embodiment of the invention is depicted in FIG. 3. Container assembly 40 is identical in all respects to the container assembly 10 described above except that it includes a closure 42 having a gasket 44 that includes a plurality of integrally molded raised areas 46. The raised areas 46 may correspond in position to the groups 34 of flutes 32 in the previously described embodiment, and are constructed and arranged to contact at least one of the external threads 16 of the finish portion 14 of the container 12 at respective lengths of contact. Each external thread will thus have a total distance spanned by a sum of such lengths of contact as well as distances spanned by adjacent raised areas on the thread. This may be thought of as conceptually corresponding to the total distance spanned in the previously described embodiment. Preferably, in this embodiment, the aggregate distance spanned that is a sum of the total distance spanned for all of the external threads is less than an internal circumference of said thread engaging portion.

In a method according to the invention, a closure such as the closure 20 or the closure 42 described above will be pressed onto a container 12 in the conventional manner after the container 12 has been filled with product in a packaging facility.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A press-on, twist-off closure for a container of the type that has at least one external thread on a finish portion thereof, comprising:

a panel portion;

a skirt portion depending downwardly from said panel portion, said skirt portion and said panel portion together defining a generally cylindrical interior recess; and a deformable gasket mounted within said interior recess, said deformable gasket having a thread engaging portion that is mounted to an inner surface of said skirt portion, and wherein said thread engaging portion comprises a plurality of raised flutes that are integral with said deformable gasket and wherein said raised flutes are arranged in a plurality of separate groups about an inner circumference of said thread engaging portion, each of said separate groups containing at least two flutes, and wherein a circumferential distance between any two adjacent groups is greater than a circumferential distance between any two adjacent flutes within a group, so that when mounted on a container the total span of contact of said flutes across individual external threads of the container will be less than if said flutes were evenly spaced, whereby the torque needed to remove the closure from the container will be less than if said flutes were evenly spaced.

2. A closure according to claim 1, wherein said panel portion and said skirt portion are metal.

3. A press-on, twist-off container assembly, comprising:

a container having a finish portion with at least one external thread defined thereon; and a press-on, twist-off type closure including a panel portion; a skirt portion depending downwardly from said panel portion, said skirt portion and said panel portion together defining a generally cylindrical interior recess; and a deformable gasket mounted within said interior recess, said deformable gasket having a thread engaging portion that is deformed so as to at least partially conform to said external threads of said finish portion of said container, said thread engaging portion having a plurality of inwardly extending raised flutes, said flutes being circumferentially spaced irregularly about said thread engaging portion, and wherein at least some of said flutes are in contact with at least one of said external threads at respective points of contact, each external thread having a total distance spanned by such points of contact, whereby said irregular spacing of said flutes will cause said container assembly to have an aggregate distance spanned that is a sum of said total distance spanned for all of said external threads that is less than it would be were the flutes spaced regularly, whereby the amount of torque that is necessary to remove the closure is comparatively reduced.

4. A container assembly according to claim 3, wherein said flutes are arranged in a plurality of groups, each of said groups containing more than one flute.

5. A container assembly according to claim 4, wherein a circumferential distance between any two adjacent groups is greater than a circumferential distance between any two adjacent flutes within a group.

6. A container according to claim 4, wherein at least a plurality of said groups contain at least three flutes.

* * * * *